United States Patent [19]

Ringesten

[11] Patent Number: 4,832,533

[45] Date of Patent: May 23, 1989

[54] PROCESS FOR REINFORCING SOIL STRUCTURE

[76] Inventor: Björn Ringesten, Birgittas Väg, S-286 00 Örkelljunga, Sweden

[21] Appl. No.: 14,189

[22] Filed: Jan. 22, 1987

Related U.S. Application Data

[63] Continuation of Ser. No. 744,003, Jun. 6, 1985, abandoned.

[30] Foreign Application Priority Data

Oct. 21, 1983 [SE] Sweden ..... 8305794

[51] Int. Cl.[4] ..... E02D 5/30

[52] U.S. Cl. ..... 405/233; 405/266

[58] Field of Search ..... 405/229–233, 405/236, 237, 240, 242, 243, 270, 266, 267, 258, 238, 269

[56] References Cited

U.S. PATENT DOCUMENTS

| | | | |
|---|---|---|---|
| 2,219,710 | 10/1940 | Litz et al. | 405/229 |
| 2,313,109 | 3/1943 | Wertz | 405/266 |
| 3,023,585 | 3/1962 | Liver | 405/269 X |
| 3,130,552 | 4/1964 | Bodine, Jr. | 405/240 |
| 3,468,131 | 9/1969 | Seidenberg . | |
| 3,541,797 | 11/1970 | Stewart | 405/269 |
| 3,626,702 | 12/1971 | Monahan | 405/229 |
| 3,854,294 | 12/1974 | Frank | 405/230 |
| 4,015,432 | 4/1977 | Ball | 405/229 |
| 4,180,350 | 12/1979 | Watts | 405/233 |
| 4,273,476 | 6/1981 | Kotulla et al. | 405/258 |
| 4,309,129 | 1/1982 | Takahashi | 405/267 |
| 4,370,077 | 1/1983 | Colgate | 405/258 |
| 4,397,588 | 8/1983 | Goughnour | 405/232 |
| 4,494,694 | 1/1985 | Pitt et al. | 405/233 |
| 4,496,011 | 1/1985 | Mazo et al. | 405/236 |
| 4,508,472 | 4/1985 | Handy et al. | 405/229 |
| 4,540,316 | 9/1985 | Takahashi | 405/266 X |
| 4,548,526 | 10/1985 | Bullivant | 405/233 |
| 4,566,825 | 1/1986 | Hirai et al. | 405/269 X |

FOREIGN PATENT DOCUMENTS

| | | |
|---|---|---|
| 377351 | 6/1975 | Sweden . |
| 410878 | 11/1979 | Sweden . |

OTHER PUBLICATIONS

J. Belfrage, F. L. Svensson, "Grundlaggning av flerbostadshus pa los jord: Finns alternativ till stodpalar?", No. 12, 1979, Byqqmastaren, Stockholm, pp. 13–15.

*Primary Examiner*—Randolph A. Reese
*Assistant Examiner*—Peter M. Cuomo
*Attorney, Agent, or Firm*—Balogh, Osann, Kramer, Dvorak, Genova & Traub

[57] ABSTRACT

Process for providing foundations and/or reinforcing the ground under buildings and other suitable constructions such as road embankments, by taking out soil and replacing it with a lighter material, which is known as laying compensating foundations. From a number of points over the area where it is intended to reinforce the ground, a plurality of holes is drilled in the soil material or is made by some other expedient soil-removing method, extending in the desired directions, in such a way that soil material is left between the holes. The soil material removed from the holes which have been made is replaced with a plastic material or some other suitable replacement material with a lower density than the removed soil material, whereby the stress diagram which the soil material bears over the actual area is obtained.

5 Claims, 1 Drawing Sheet

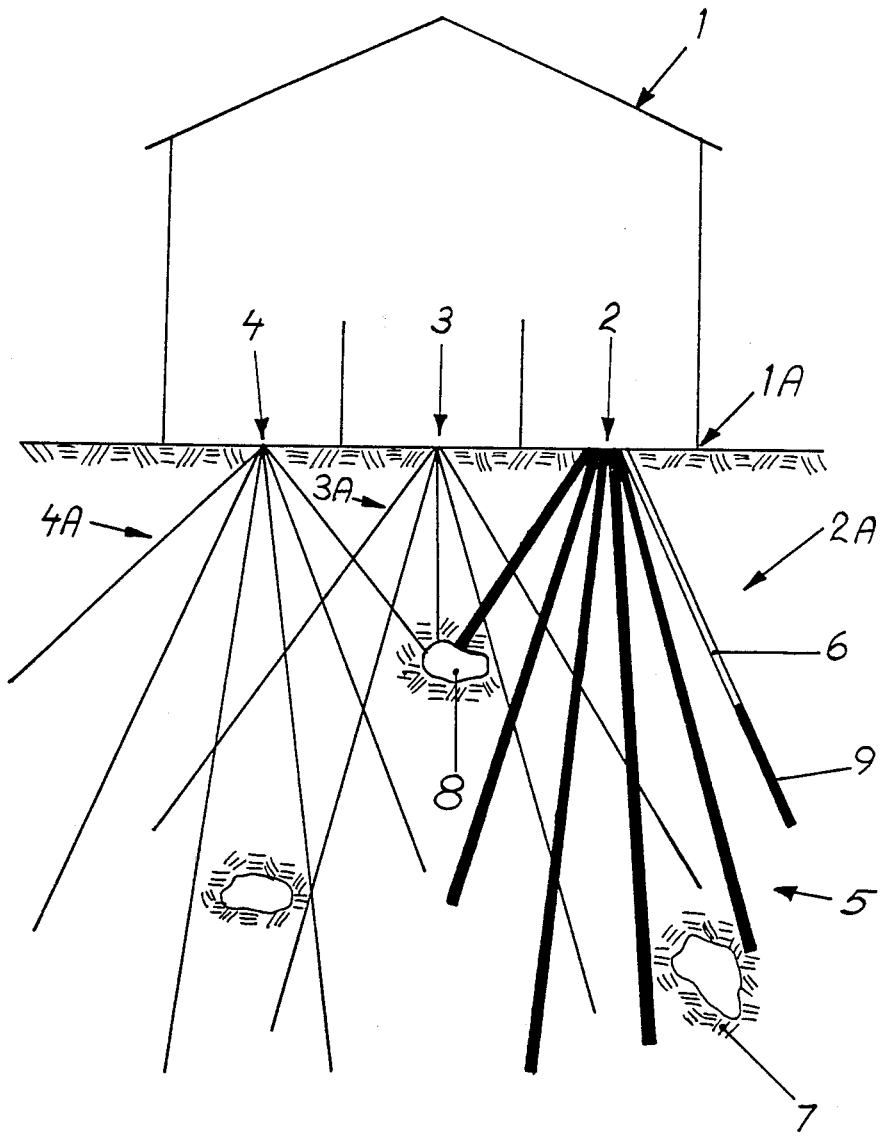
1
4
3
2
1A
3A
4A
2A
6
9
8
5
7

PROCESS FOR REINFORCING SOIL STRUCTURE

This application is a continuation of application Ser. No. 744,003, filed June 6, 1985, now abandoned.

BACKGROUND OF THE INVENTION

1. Field of the Invention

The present invention relates to a process for providing foundations and/or reinforcing the ground under buildings, for example, and other suitable constructions such as road embankments, by taking out soil and replacing it with a lighter material, which is known as laying compensating foundations.

2. Description of the Prior Art

Relieving foundations laid in ground which will not bear increased loading by removing soil material and replacing it with a lighter material, known as laying compensating foundations, to provide foundations for new constructions, such as buildings, roadways, airports, etc. has been effected hitherto by providing cellars below the building or by using sintered clay or expanded plastics to fill large holes excavated in the ground and extending under the entire lower surface of the building, as shown for example in U.S. Pat. No. 3,626,702. The known methods are costly and cannot be used effectively for reinforcing the ground under constructions which have already been completed.

SUMMARY OF THE INVENTION

The main object of the present invention is therefore to provide a process which solves the problem so that it is substantially possible to obtain the stress diagram which the ground bears with ground-reinforcement.

This object is achieved by means of a process according to the present invention which is essentially characterised in that from a number of points over the area where it is intended to reinforce the ground, a plurality of holes is drilled in the soil material, or is made by some other expedient soil-removing method, extending in the desired directions, in such a way that soil material is left between the holes, and the soil material removed from the holes which have been made is replaced with plastic material or some other suitable replacement material with a lower density than the removed soil material, whereby the stress diagram which the soil material bears over the actual area is obtained.

BRIEF DESCRIPTION OF THE DRAWINGS

The invention is described below by way of a number of preferred embodiment examples, with reference to the accompanying drawing which shows a cross-section through ground reinforcement under a building which has already been erected.

DESCRIPTION OF THE PREFERRED METHOD

The provision of ground reinforcement under a building 1 shown on the drawing, or some other appropriate construction, by laying so-called compensating foundations is effected according to the present invention in the following way:

From one point or from a plurality of points 2, 3, 4, etc. in the area 5, for example under the building 1, where it is desired to reinforce the ground by means of the process according to the invention, a plurality of holes 6 extending in the desired directions are made in the soil material 7, such as clay, for example. A suitable procedure for making the holes 6 is by drilling in the ground with suitable drilling equipment so that elongated ducts are produced whereof the depth, width and number are based on calculations for the site conditions involved.

In the following text drilling will be described, although other suitable methods for producing the holes can be used, for example boring/dividing with fine high-pressure jets and extraction on the slurry principle, or with compressed air.

The example shown involves drilling from a plurality of drilling points 2–4 situated spaced out from each other, from the base 1A of the building 1 straight down and/or downwards at an angle in a plurality of directions in the ground 7 under the building 1, so that the area it is intended to reinforce is perforated with borehole-like holes 6, spreading out in systems from a common point 2–4 like a sheaf 2A, 3A, 4A of diverging rays, to the calculated penetration depth and with a hole width which has been calculated. It is also possible to have other expedient configurations, for example when boring is to be effected sideways or upwards in under the buildings etc. from tunnels, shafts or cellars. The main point is that soil material remains between the holes 6.

In whatever way the holes 6 are bored, the clay 7 removed from the actual borehole 6 in an expedient way, or the soil material in which the bores are made, is replaced with a plastic material or some other suitable replacement material 9, which has a lower density than the removed soil material, so that the stress diagram which existed before the construction work is substantially retained in the soil material 7 located in the actual ground-reinforcement area 5. Thus, columns extending in various desired directions are produced, the function of which is essentially to make the layer of soil in the ground-reinforcement area 5 lighter than it was before the ground-reinforcing process was carried out.

The holes 6 are either bored to the full depth and filled with replacement material 9 in one step, or the said boring and filling is effected in stages, depending on the calculations and the desired depth. In soft ground the holes 6 are made deeper and are filled with plastic or some other appropriate replacement material 9 in stages so that an economical diameter is achieved without the hole caving in. If obstructions 8 are encountered, such as large stones for example, boring or hole-making is stopped, and either the surrounding holes 6 are bored etc. deeper, or more holes are bored than was originally calculated.

Suitable filling material 9 is a material which is lightweight and which displays the characteristic of absorbing as little water as possible, thus preferably some suitable type of plastic material. Plastic balls with various dimensions, pieces of foam plastic from the finishing process and cemented together, for example with foam plastic, foam plastic material with closed cells which is moulded on site, or prefabricated plastic tubing made of foam plastic material which can have a waterproof skin, are examples of some suitable alternatives for the lightweight replacement filling material 9. By mixing reinforcing material such as short glass-fiber fibers for example in one or more components, it is possible to reinforce the filling material involved, such as a foam plastic, in an effective way, so that it displays the desired rigidity. The rigidity of the replacement material, i.e. its deformation characteristics, can be selected when choosing the material.

The boring equipment for making the holes 6 from a building 1 should be easy to handle, compact and able to be dismantled, so that it can be lowered and accommodated easily in confined cellar spaces, etc. from which it is intended to bore. For example, a screw-type drill can be used, by means of which the clay column through which the drill has been screwed is drawn out of the ground in stages, and filling is also effected in stages or after the full depth of the borehole has been attained. An ejector arrangement of a known kind, preferably a high-pressure ejector, is also suitable for making the holes 6 in the ground. By means of a fluid, such as water, for example, loosened and suitably broken-down soil material can be conveyed out of the holes 6 thus made by means of a pump arrangement, preferably a pump which functions with a fluid and which is known as a slurry pump. The suspension which has been pumped out can be supplied to a collecting container such as a tank, for example, and/or supplied to the drainage network, when this is possible.

When boring and filling is carried out in stages the hole which has been bored is filled with replacement material 9, for example plastic tubing or foam plastic tubing, which can be made in smaller lengths, or by making a moulding round the circumference of the drill from the mouth end of the hole. An internal duct-like elongated hole is formed thereby at the center of the replacement material, through which the drill equipment can be displaced when completing the borehole in the ground, preferably after the arms bearing the ejector nozzle have been inserted towards the center axis of the borehole. Appropriate depths for stepwise boring without the ground around the borehole collapsing can be calculated and adopted.

When the borehole 6 is bored to its full penetration depth, followed by the filling of the borehole 6 with the replacement material 9, this material 9 is fed into the hole 6 so that the column is built up with the material from the bottom of the borehole to the desired level, as described above.

With the present invented process it is possible to relieve substantially homogeneously the whole of the underlying area 5 under a building 1, for example, so that the ground is perforated to the selected depth and width and is filled with lightweight columns or bodies with some other shaping, which extend in the desired directions, for example as described above. The function of the replacement material 9 supplied is not to support the building 1 as in conventional pilework, but the aim is to relieve the underlying layer of soil and thereby to improve the loading characteristics of the ground. The distribution of the replacement material is chosen so that a homogeneous loading situation is obtained for the material under constructions. Subsidence which has already occurred can be compensated in this way, if required.

The invention is not restricted to the embodiment example described above and shown on the drawing, but may be modified within the framework of the following Patent Claims without exceeding the scope of the invention.

I claim:

1. A process for providing and reinforcing foundations in soft clay-like ground under buildings, road embankments and the like by taking out soil material from a predetermined area of the ground which cannot bear increased loading and replacing it with a lighter material so as to relieve said area of the ground, making it lighter than before subjected to increased loading and obtaining improved loading characteristics therefor, the process comprising drilling a plurality of holes in the form of elongated ducts from a number of points in said predetermined area of the ground, said plurality of holes each having a predetermined number of rays, each ray having cylindrical penetration depth and width depending on conditions of said predetermined area of the ground, and extending in systems, each system having a common point and having respective rays extending in a plurality of directions in the ground like a sheaf of diverging rays, removing drilled soil material from said drilled holes, and replacing in said holes, said drilled soil material with a plastic material having a lower density than said drilled soil material, said plastic material having liquid-repelling characteristics, so as to make said area of the ground lighter than it was before initiating said process, obtaining a homogeneous loading situation therefor and improved loading characteristics.

2. A process according to claim 1, wherein said replacing step comprises using a plastic composition material having liquid-repelling characteristics and containing fibers of glass-fiber for reinforcement thereof.

3. A process according to claim 1, wherein said replacing step comprises using a foam plastic material having closed cells which is molded on site.

4. A process according to claim 1, wherein said replacing step comprises using as replacement material, suitably dimensioned plastic balls, foam plastic pieces which are joined together and prefabricated plastic tubing parts.

5. A process for relieving and reinforcing clay-like soft ground under already existing buildings, road embankments and the like by taking out soil material from the ground and replacing it with a lighter material thereby improving loading characteristics of the ground, the process comprising establishing a number of common points from which drilling is to commence in an area occupied by an existing structure which is subjected to increased loading, drilling a plurality of holes in the form of elongated ducts from each common point, at each common point, radiating in different directions, each plurality of radiating holes having a predetermined number of holes, penetrating depths and widths depending on conditions of said area of the ground, and extending in radiating systems each from said common point in a plurality of directions in the ground, removing drilled soil material from said drilled holes, and replacing in said holes said drilled material with a plastic material having a lower density than said drilled soil material so as to make said area of the ground lighter than it was before initiating said process and relieve substantially and homogeneously the whole of said area of the ground subjected to increased loading.

* * * * *

UNITED STATES PATENT AND TRADEMARK OFFICE

CERTIFICATE OF CORRECTION

PATENT NO. : 4,832,533

DATED : May 23, 1989

INVENTOR(S) : Bjorn Ringesten

It is certified that error appears in the above-identified patent and that said Letters Patent is hereby corrected as shown below:

On the cover page, Item [63] should read --[63] PCT /SE84/00333, filed October 11, 1984. Continuation of Ser. No. 744,003, June 6,1985, Abandoned--.

Signed and Sealed this

Tenth Day of April, 1990

*Attest:*

HARRY F. MANBECK, JR.

*Attesting Officer*

*Commissioner of Patents and Trademarks*